US006328581B1

(12) United States Patent
Lee et al.

(10) Patent No.: US 6,328,581 B1
(45) Date of Patent: Dec. 11, 2001

(54) UNIVERSAL ELECTRIC ADAPTER

(76) Inventors: Chiu-Shan Lee; Shen Su-Chen Li, both of No. 31, Lane 18, Chang-Chun Rd., Hsintien City, Taipei County (TW)

( * ) Notice: Subject to any disclaimer, the term of this patent is extended or adjusted under 35 U.S.C. 154(b) by 0 days.

(21) Appl. No.: 09/637,695

(22) Filed: Aug. 15, 2000

(51) Int. Cl.[7] ..... H01R 13/648

(52) U.S. Cl. ..... 439/106; 439/222; 439/166; 439/171; 439/649; 439/653

(58) Field of Search ..... 439/106, 222, 439/653, 107, 108, 109, 649, 650, 166, 171, 174, 175

(56) References Cited

U.S. PATENT DOCUMENTS

| | | | | |
|---|---|---|---|---|
| 5,626,495 | * | 5/1997 | Drewnicki | 439/651 |
| 5,836,777 | * | 11/1998 | Chen | 439/222 |
| 6,010,347 | * | 1/2000 | Lee | 439/222 |
| 6,227,883 | * | 5/2001 | Lee et al. | 439/106 |

* cited by examiner

*Primary Examiner*—Hien Vu
*Assistant Examiner*—Truc Nguyen
(74) *Attorney, Agent, or Firm*—Rosenberg, Klein & Lee

(57) ABSTRACT

A universal electric adapter includes a casing injection-molded from plastics, the casing having a front face panel, two lateral receiving chambers, a middle receiving chamber, a locating groove inside the middle receiving chamber, a plurality of coupling flanges radially inwardly disposed around a rear open side thereof, a positioning projection radially inwardly suspended in the rear open side, and two locating grooves bilaterally disposed at the periphery thereof; two metal contact frames respectively installed in the lateral receiving chambers the metal contact frames each having a protruded contact strip; a grounding frame installed in the middle receiving chamber, the grounding frame having a contact base, and a locating flange fastened to the locating groove inside the middle receiving chamber; a plug member fastened to the rear open side of the casing, the plug member having a plurality of metal prongs adapted for fastening to an electric socket, a plurality of coupling grooves spaced around the periphery thereof and respectively engaged with the coupling flanges of the casing, and a plurality of peripheral notches respectively disposed in communication with the coupling grooves of the plug member and adapted to receive the coupling flanges of the casing for enabling the coupling flanges of the casing to be respectively forced into engagement with the coupling grooves of the plug member upon a relative rotation motion between the plug member and the casing; and two grounding plates respectively fastened to the locating grooves of the casing and disposed in contact with the grounding frame.

15 Claims, 19 Drawing Sheets

| CODE | APPLICATION AREA | SPECIFICATION |
|---|---|---|
| A | British standards: HK, Malaysia, Uganda, Singapore, Arabian countries | 13A250V |
| B | British colonies, India | 5A250V<br>15A250V |
| C | China, New Zealand, Australia | 10A250V |
| D | Denmark | 15A250V |
| E | Middle East | 15A250V |
| F | Middle East | 15A250V |
| G | American standards: Taiwan, Japan, USA, Canada, Cuba, Venezuela, Costa Rica, Guam Dominique, Ecudor, Hawaii, Salvador Haiti, Honduras, Maxico, Panama, Nicalagua<br><br>Philippines, Thanland, Guatemala, Paragua | 125V<br><br>250V |
| H | Taiwan, Japan, USA, Canada | 20A250V |
| I | Taiwan, Japan, USA, Canada | 15A250V |
| J | China | |
| K | Italy | 10-16A250V |
| L | Swiss | 10-16A250V |
| M | Taiwan, Japan, USA, Canada<br>China, Philippines, Tailand | 15A250V<br>250V |
| N | China, New Zealand, Australia | 250V |
| O | Russia, Europe | small electric home appliance 250V |
| P | German, Europe (with side grounding) | 10-16A250V |
| Q | Conventional British and Hong Kong Types | 250V |

FIG.12D

UNIVERSAL ELECTRIC ADAPTER

BACKGROUND OF THE INVENTION

The present invention relates to an universal electric adapter, and more particularly to such a universal electric adapter, which comprises a plug member at one side adapted for connection to any of a variety of electric sockets, and a face panel at an opposite side adapted for receiving any of a variety of electric plugs.

FIG. 22 shows an electric adapter according to the prior art. This structure of electric adapter comprises a casing 6, a set of metal contact plates 613 respectively installed in the back side of the casing 6, a plug member 62 covered on the back side of the casing 6, the plug member 62 having a set of metal prongs 621 respectively disposed in contact with the metal contact plates 613, a grounding frame 612 and two metal contact frames 611 respectively installed in the front side of the casing 6 and disposed in contact with the metal contact plates 613, and a socket member 61 covered on the front side of the casing 6 and adapted to receive an electric plug. This structure of electric adapter has numerous drawbacks including (1) complicated structure with numerous component parts; (2) high manufacturing cost; (3) possible contact failure between the metal contact plates and the metal contact frames/grounding frame, and (4) not suitable for use with an electric socket of German or French specification. FIG. 23 shows another structure of universal electric adapter according to the prior art. This structure of electric adapter comprises a casing 6 having an electric socket (not shown) at the front side thereof, and an electric plug 614 of German specification fastened to the backside 615 thereof. This design is expensive, and requires much installation space.

SUMMARY OF THE INVENTION

The invention has been accomplished under the circumstances in view. According to one aspect of the present invention, the universal electric plug comprises a face panel at the front side thereof adapted to receive any of a variety of electric plugs, and a plug member at the rear side thereof adapted to receive any of a variety of electric socket. According to another aspect of the present invention, the face panel may be integral with a computer socket adapted to receive a computer plug. According to still another aspect of the present invention, the face panel is equipped with a safety cover to prevent an insertion of an external object by an accident.

BRIEF DESCRIPTION OF THE DRAWINGS

FIG. 12D is a specification table showing different electric plugs for use in different countries.

DETAILED DESCRIPTION OF THE PREFERRED EMBODIMENT

Figure 8A:
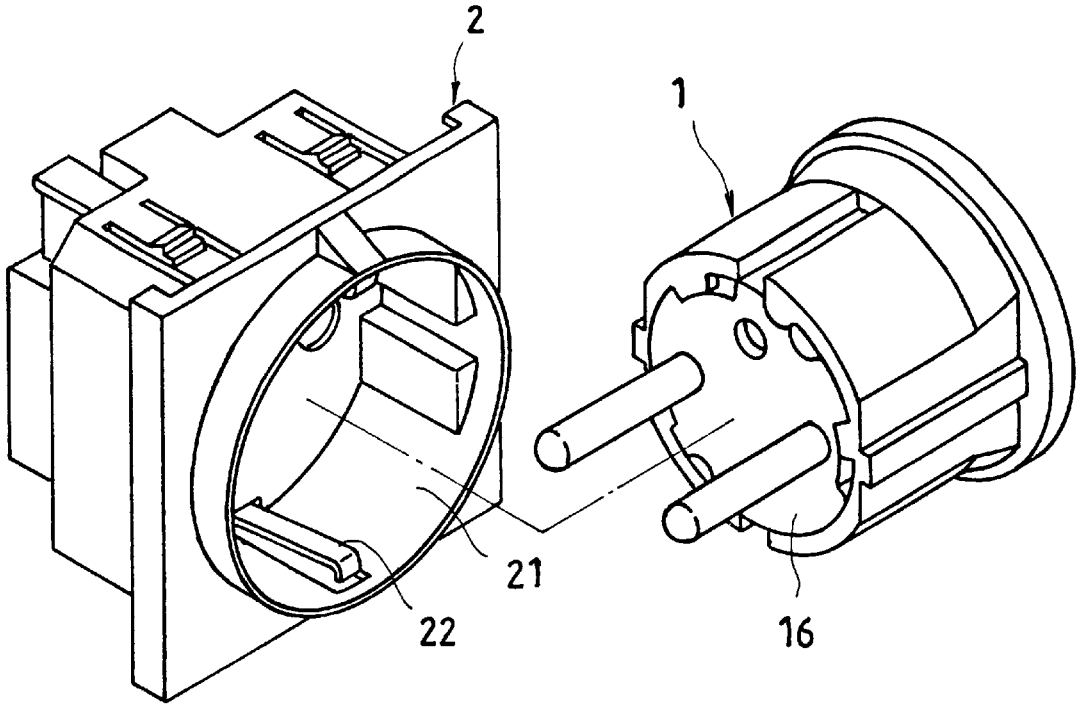
FIG. 8A illustrates an alternate form of the universal electric adapter adapted to receive an electric socket of German specification.
Figure 8B:
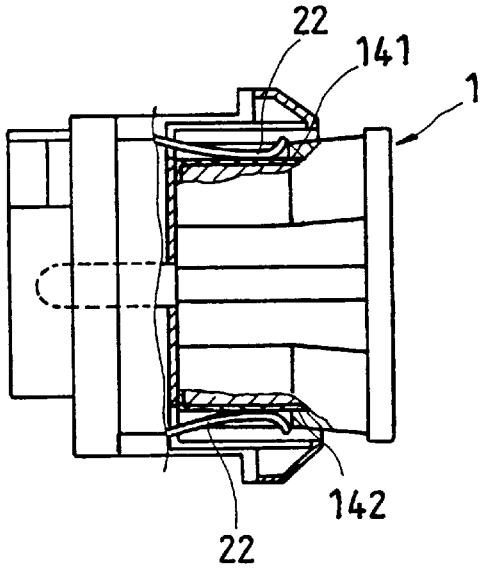
FIG. 8B is a sectional assembly view of FIG. 8A.
Figure 9A:
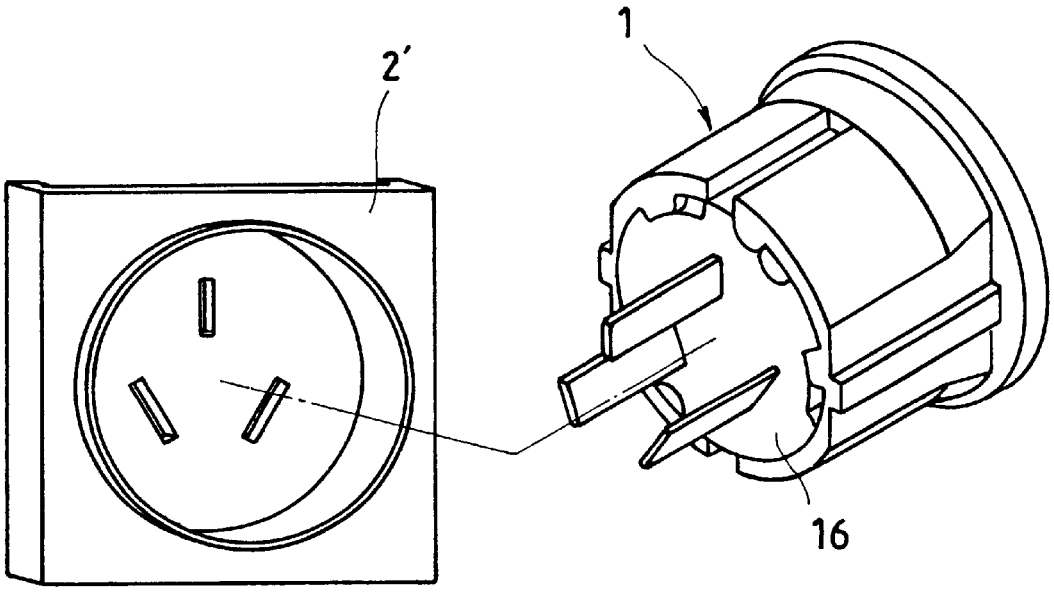
FIG. 9A illustrates another alternate form of the universal electric adapter adapted to use with an electric socket of Australian specification.
Figure 9B:
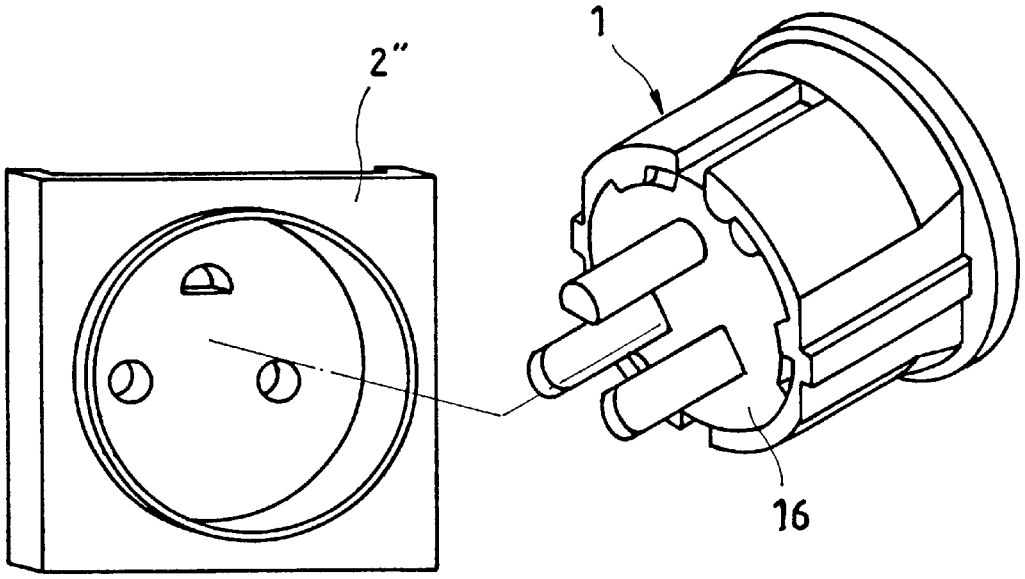
FIG. 9B illustrates still another alternate form of the universal electric adapter adapted to use with an electric socket of Denmark specification.

Referring to FIGS. from 1 through 4, a universal electric adapter 1 is shown comprising a casing 11 injection-molded from plastics and constructed subject to the related German electric code, the metal contact frames 121, a grounding frame 1231, a first grounding plate 141, a second grounding plate 142, and a plug member 16. The casing 11 comprises a face panel 111 disposed at the front side thereof, two lateral receiving chambers 12 bilaterally disposed on the inside and backwardly extended to the rear open side thereof, which receive the metal contact frames 121 respectively, a middle receiving chamber 13 disposed on the inside in the middle between the lateral receiving chambers 12 and backwardly extended to the rear open side, which receives the grounding frame 131, a locating groove 132 disposed inside the middle receiving chamber 13, a plurality of coupling flanges 15 radially inwardly disposed around the rear open side, a positioning projection 151 radially inwardly suspended in the rear open side, and two locating grooves 14 disposed at the periphery at two opposite sides, which receive the grounding plates 141 and 142 respectively. The metal contact frames 121 arc respectively installed in the lateral receiving chambers 12 inside the casing 11, each comprising a protruded contact strip 122. The grounding frame 131 is installed in the middle receiving chamber 13 inside the casing 11, comprising a contact base 1311, and a locating flange 1312 fastened to the locating groove 132 inside the middle receiving chamber 13. The plug member 16 comprises a plurality of backwardly extended metal prongs 161 adapted for fastening to an electric socket, a plurality of coupling grooves 162 spaced around the periphery and adapted for engagement with the coupling flanges 15 of the casing 11, a plurality of peripheral notches 1621 respectively disposed in communication with the coupling grooves 162 and adapted to receive the coupling flanges 15 of the casing 11 for enabling the coupling flanges 15 to be respectively forced into engagement with the coupling grooves 162 upon a relative rotation motion between the plug member 16 and the casing 11, and a peripheral positioning recess 162 adapted to receive the positioning projection 151 of the casing 11. The grounding plates 141 and 142 are respectively fastened to the locating grooves 14 of the casing 11, and disposed in contact with the grounding frame 131. When the plug member 16 of the universal electric adapter 1 into the receiving side 21 of an electric socket 2 constructed according to German electric code, the grounding plates 141 and 142 are respectively forced into contact with respective grounding terminals 22 in the receiving side 21 of the electric socket 2 (see FIGS. 8A and 8B). The plug member 16 can be constructed subject to Australia or Denmark's electric code, and adapted for connecting to an electric socket of Australia specification 2' or electric socket of Denmark specification 2" (see FIGS. 9A and 9B).

Figure 10:
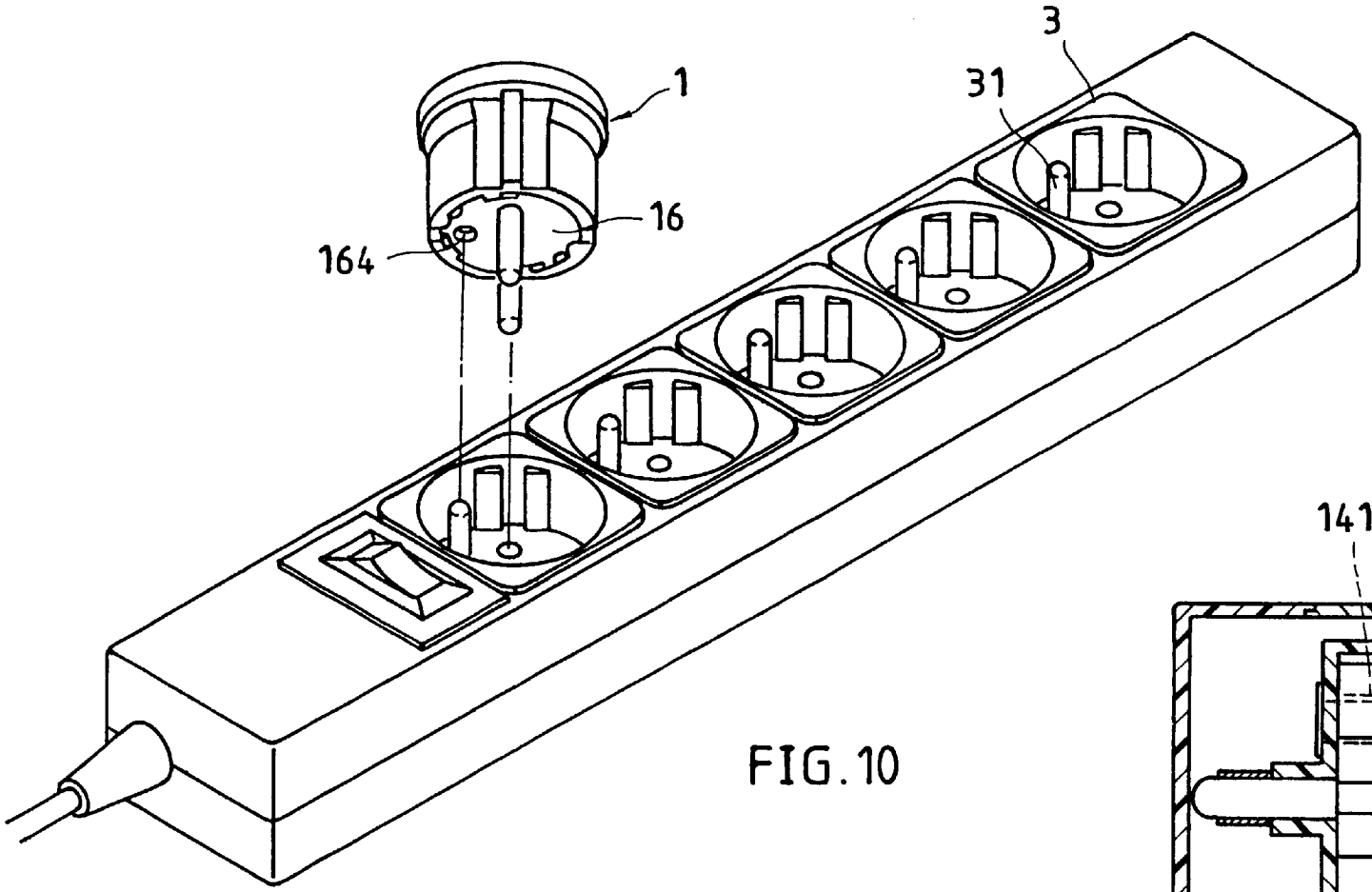
FIG. 10 illustrates still another alternate form of the universal electric adapter adapted to use with an electric outlet of German specification.
Figure 11:
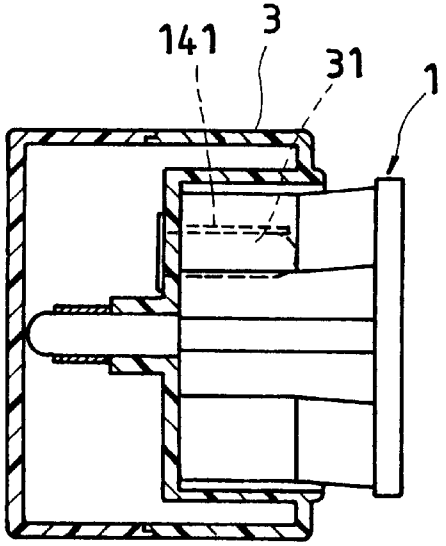
FIG. 11 is a sectional view of the present invention, showing the universal electric adapter installed in an electric socket of French specification.

Referring to FIGS. 10 and 11 and FIGS. 3 and 4 again, in order for enabling the universal electric adapter 1 to be used with an electric socket of French specification 3, the plug member 16 is positioned on the casing 11 at a deflection angle relative to the plug holes 112 on the face panel 111 of the casing 11 (i.e., the metal prongs 161 of the plug member 16 are not in alignment with respective plug holes 112 on the face panel 111 of the casing 11). however the metal prongs 161 are maintained in contact with the contact strip 122 of each metal contact frame 121. Further, the plug member 16 comprises a plug hole 164 adapted for receiving the grounding prong 31 of the electric socket of French specification 3, enabling the grounding prong 31 to contact a contact flange 1411 of the first grounding plate 141.

Figure 1:
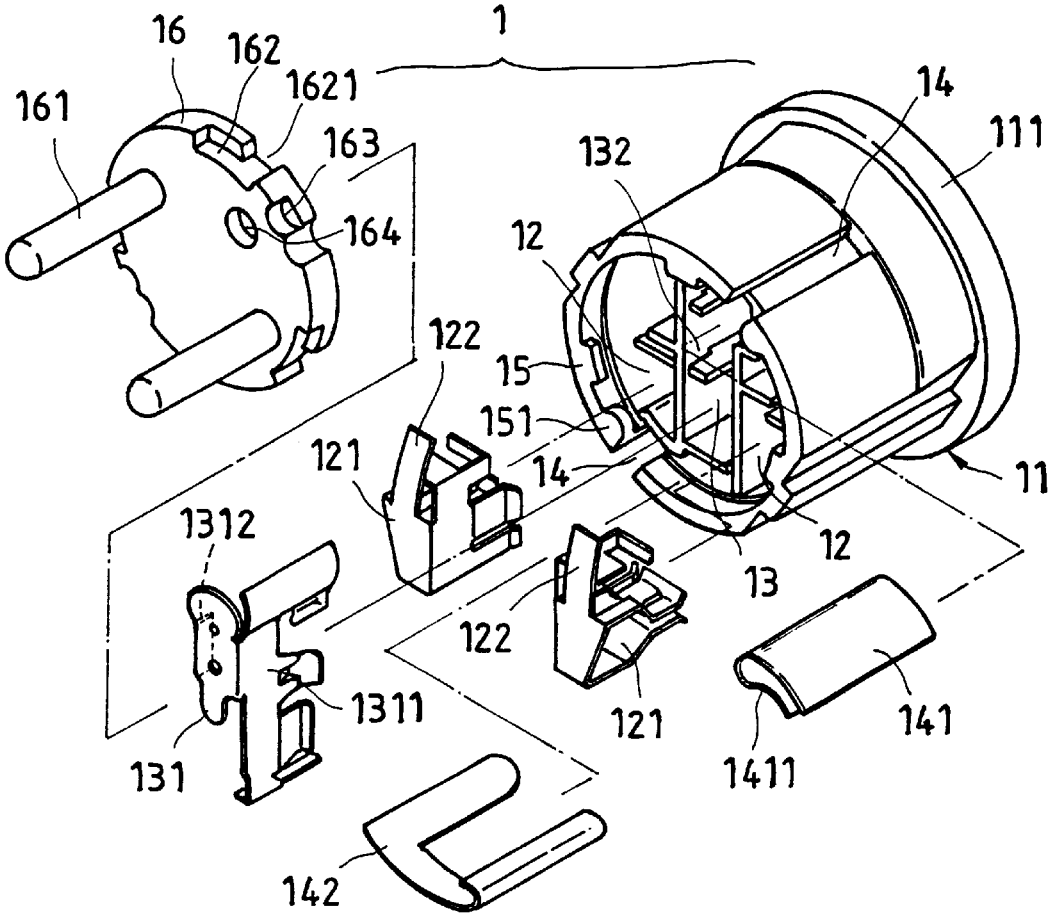
FIG. 1 is an exploded view of a universal electric adapter according to one embodiment of the present invention.
Figure 2:
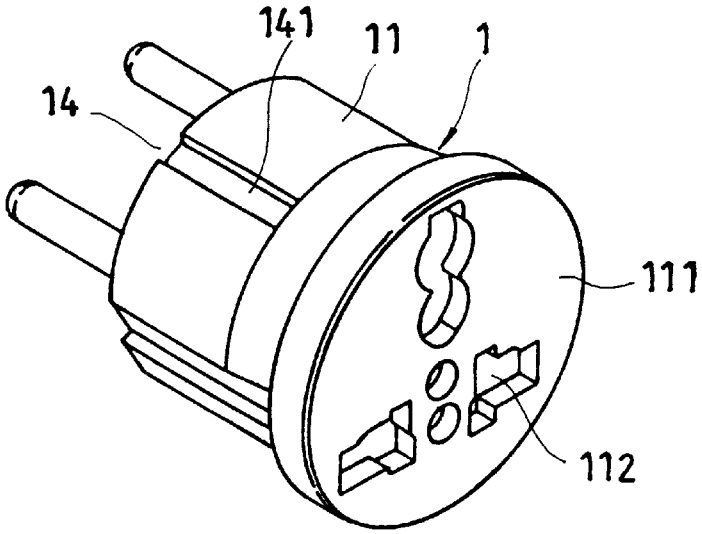
FIG. 2 is an assembly view of the universal electric adapter shown in FIG. 1.
Figure 3:
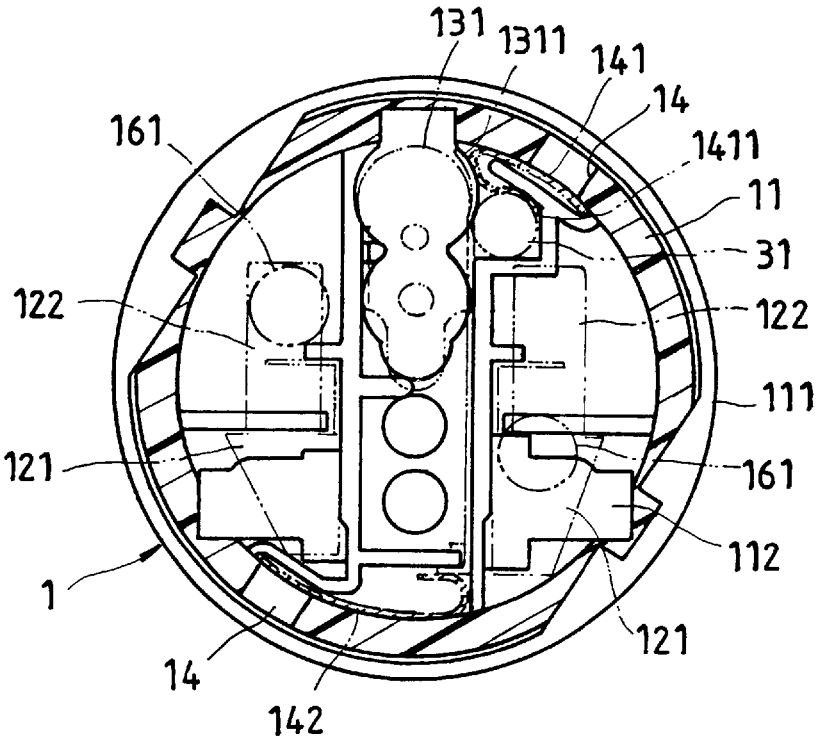
FIG. 3 is a cross sectional view in an enlarged scale of the universal electric adapter shown in FIG. 2.
Figure 4:
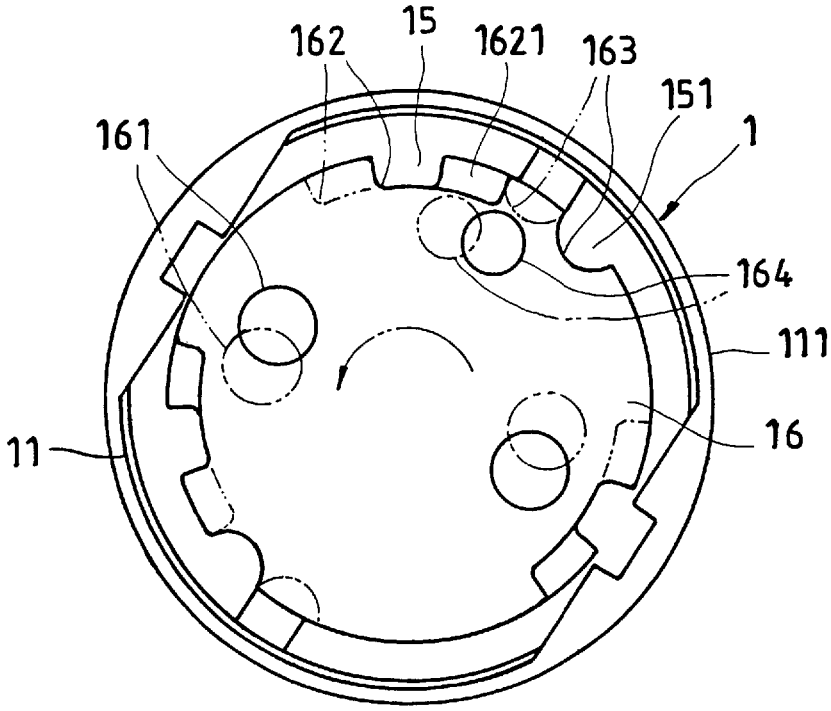
FIG. 4 is a schematic drawing showing the installation of the plug member in the casing according to the present invention.
Figure 5:
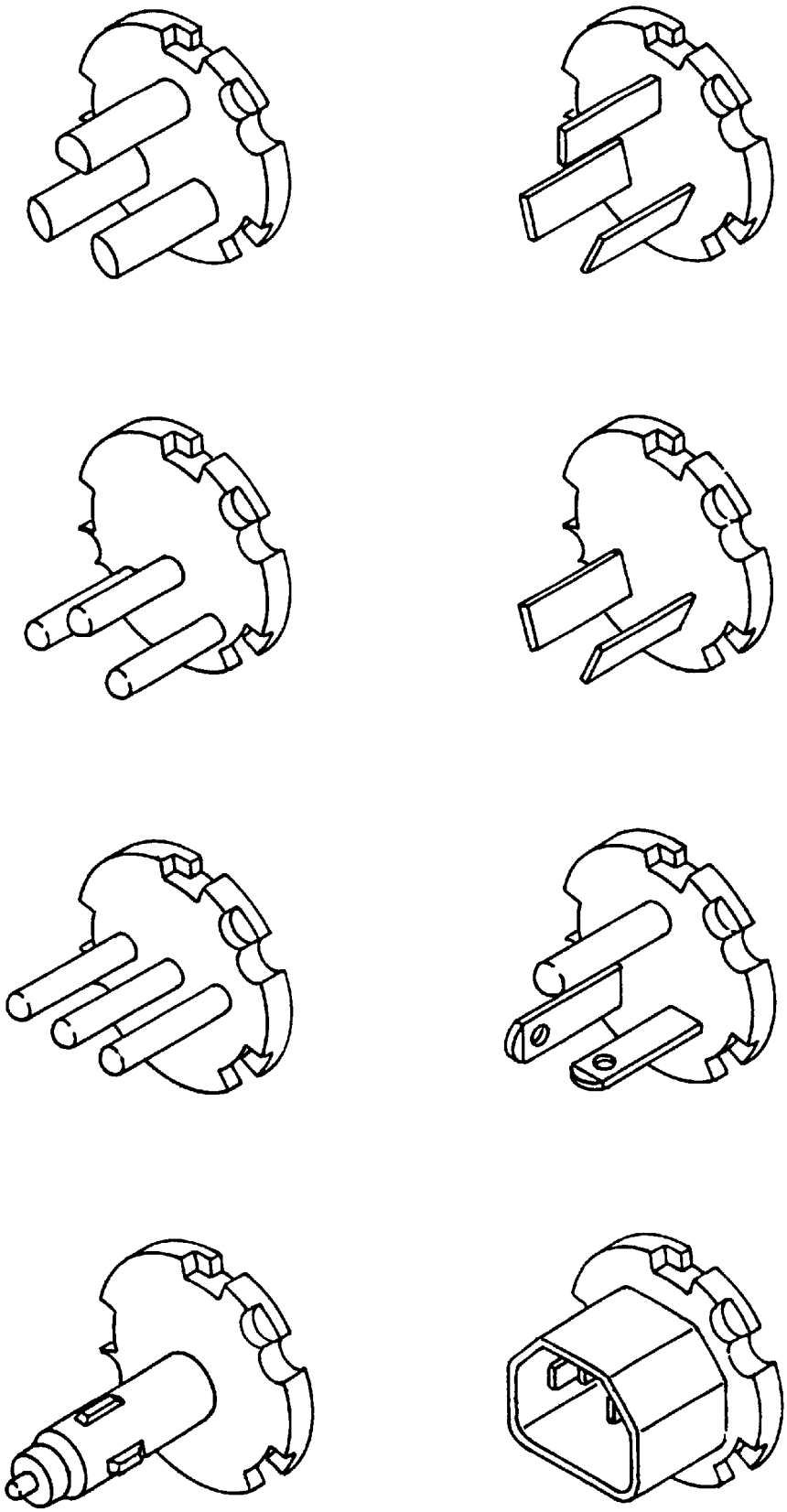
FIG. 5 illustrates a set of different plug members constructed according to the present invention.
Figure 6:
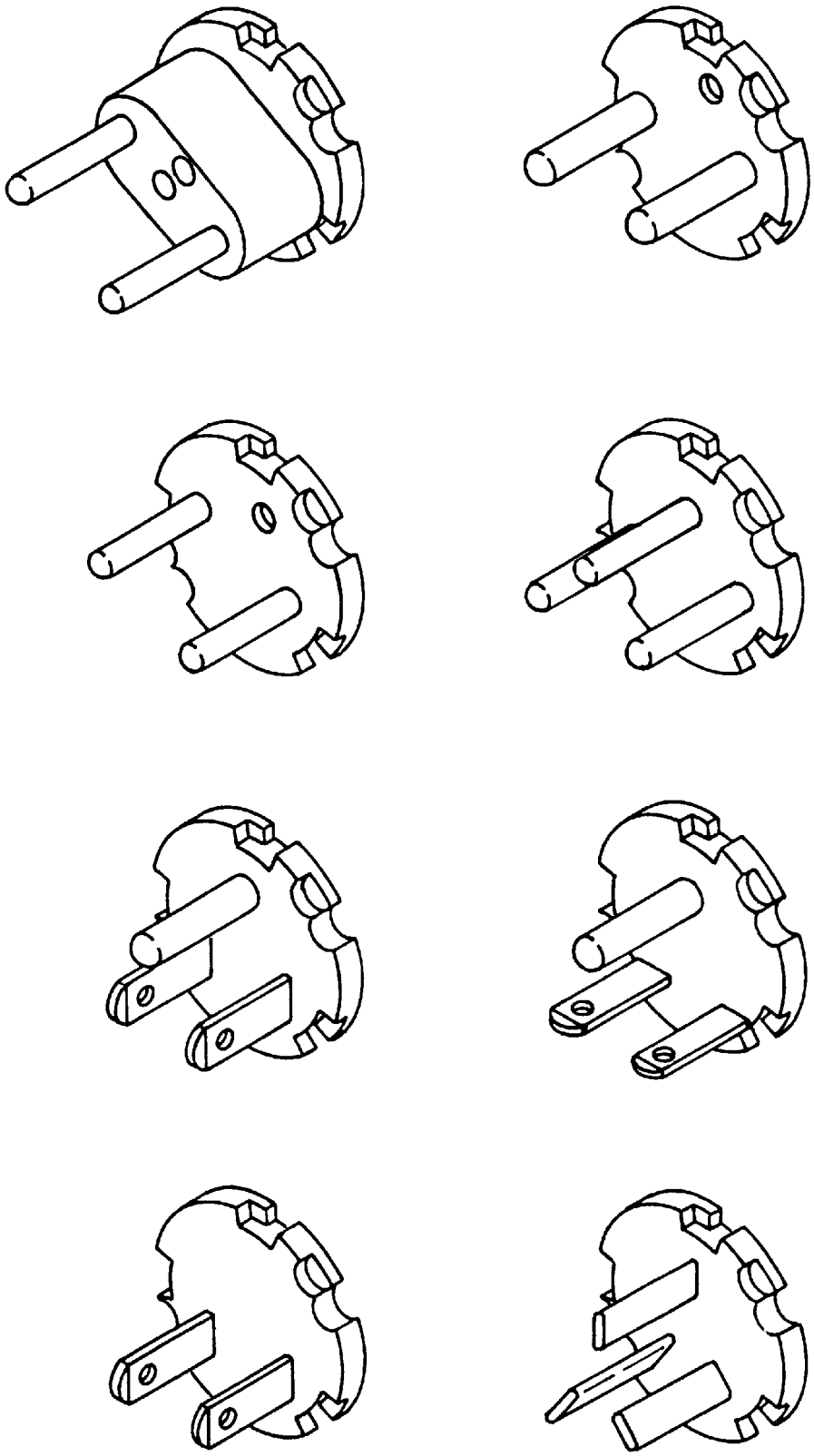
FIG. 6 illustrates further another set of different plug members constructed according to the present invention.

Referring to FIGS. 5 and 6 and FIG. 2 again, the plug member 16 may be variously embodied to fit different specifications subject to different electric codes of different countries.

Figure 7:
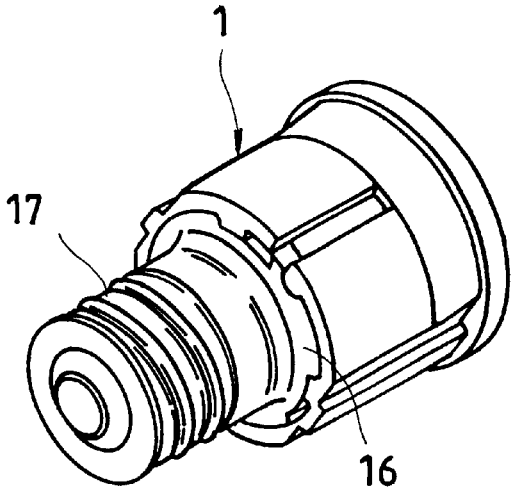
FIG. 7 is an elevational view of still another alternate form of the plug member according to the present invention.

Referring FIG. 7, the plug member 16 may be integral with a lamp head 17 adapted for connecting to a lamp socket through a rotary motion.

Figure 12A:
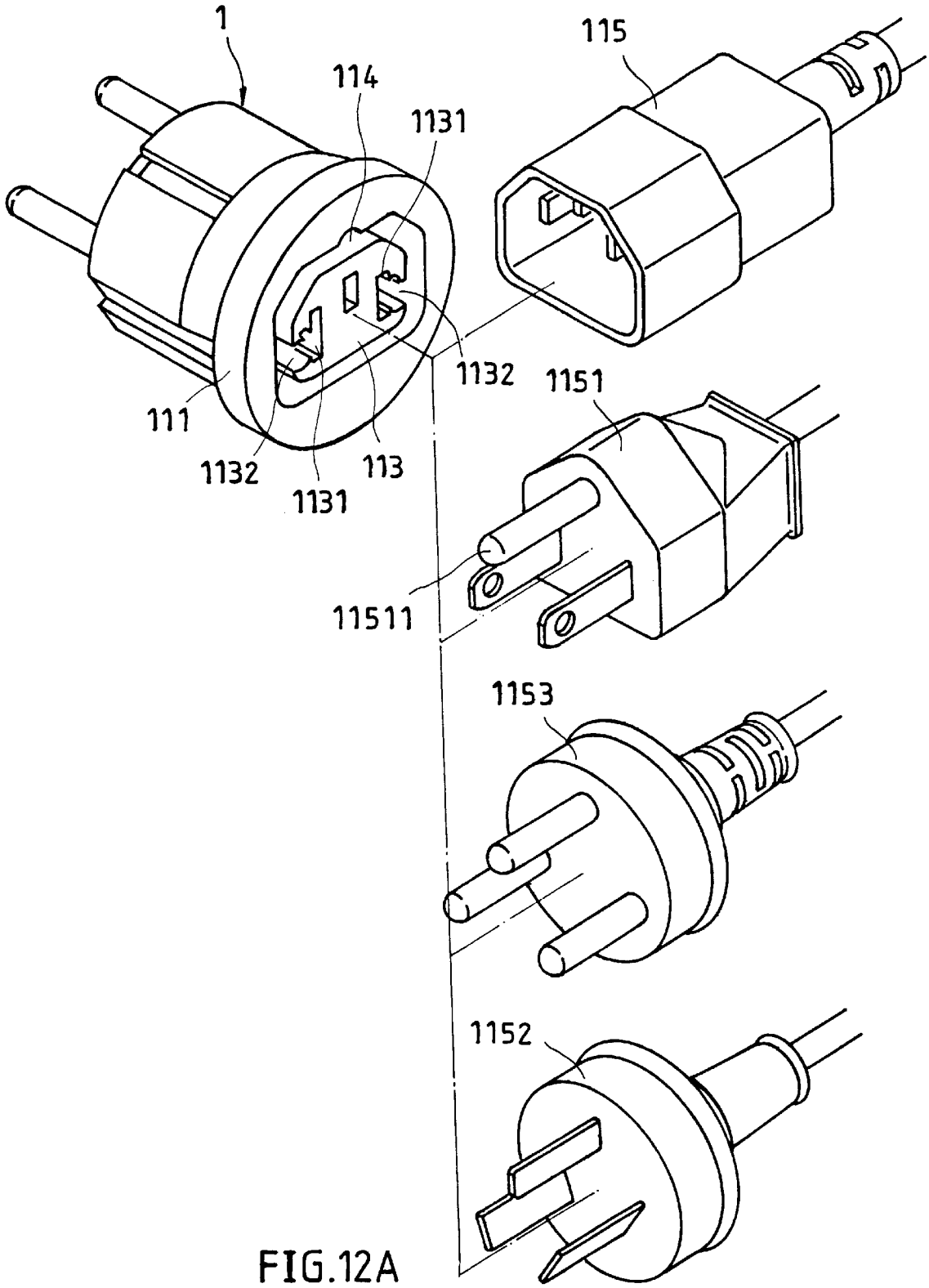
FIG. 12A shows still another alternate form of the universal electric adapter adapted for use with different electric plugs.

Referring to FIGS. 12A, the face panel 111 of the universal electric adapter 1 comprises a computer socket 113 adapted to receive a computer plug 115. The computer socket 113 has hot and neutral power plug holes 1131, a grounding plug hole 114 and two symmetrical openings 1132 respectively bilaterally disposed in communication with the hot and neutral power plugholes 1131. This design of computer socket 113 enables the face panel 111 to receive any of a variety of electric plugs 115, 1151, 1152, 1153 having a grounding terminal 11511.

Figure 13:
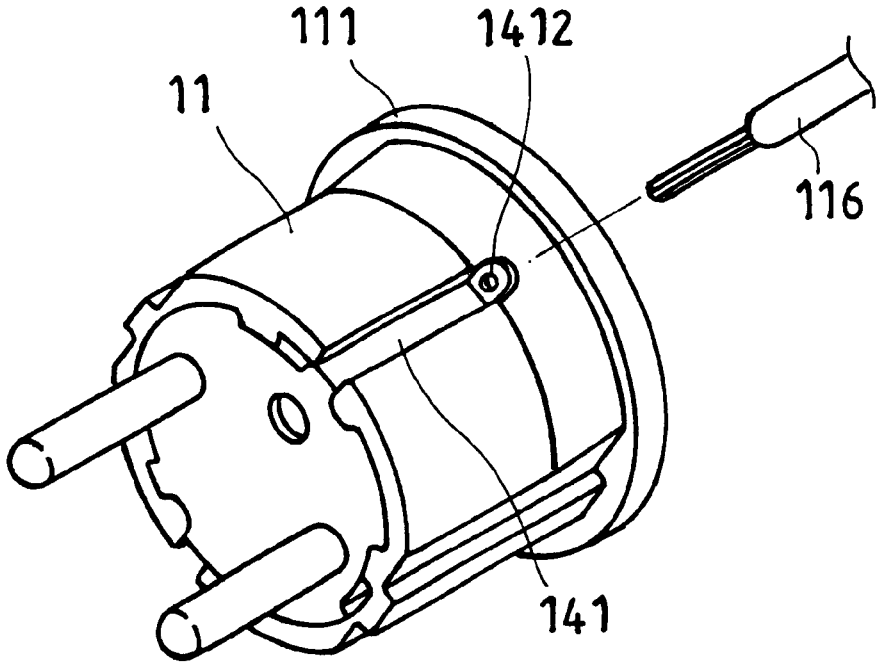
FIG. 13 shows still another alternate form of the universal electric adapter according to the present invention.
Figure 14:
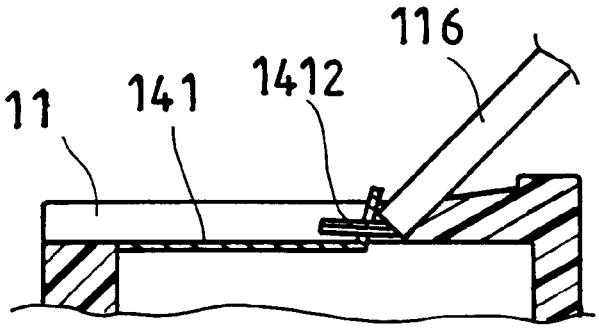
FIG. 14 is a sectional view of a part of the present invention, showing the grounding wire fastened to the first grounding plate.
Figure 15:
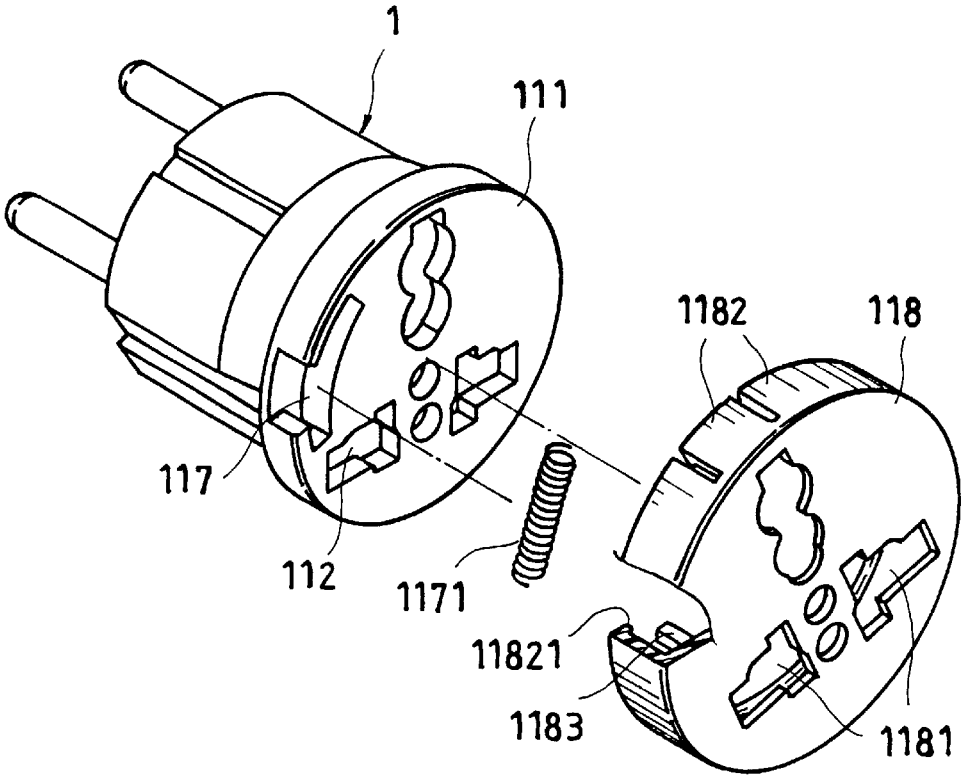
FIG. 15 is an exploded view of still another alternate form of the present invention.
Figure 16:
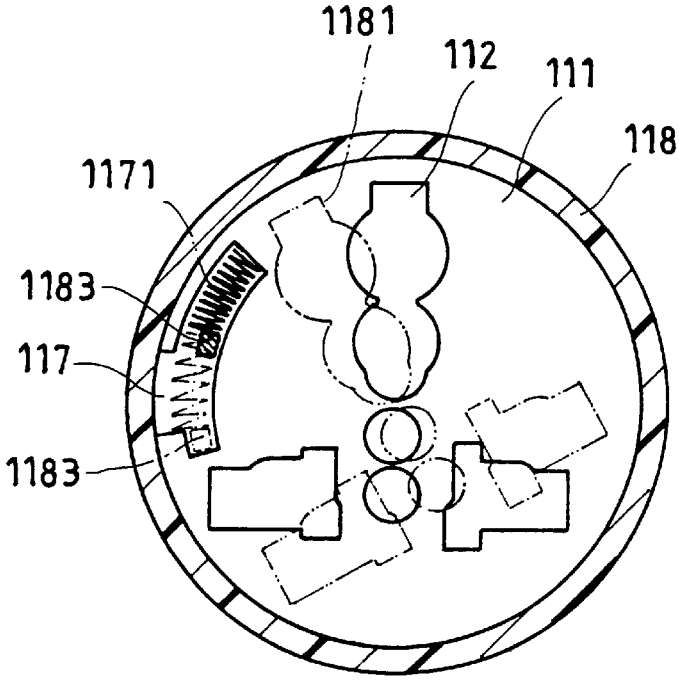
FIG. 16 is a sectional view of the embodiment shown in FIG. 15. showing the installation of the safety cover on the face panel.
Figure 17A:
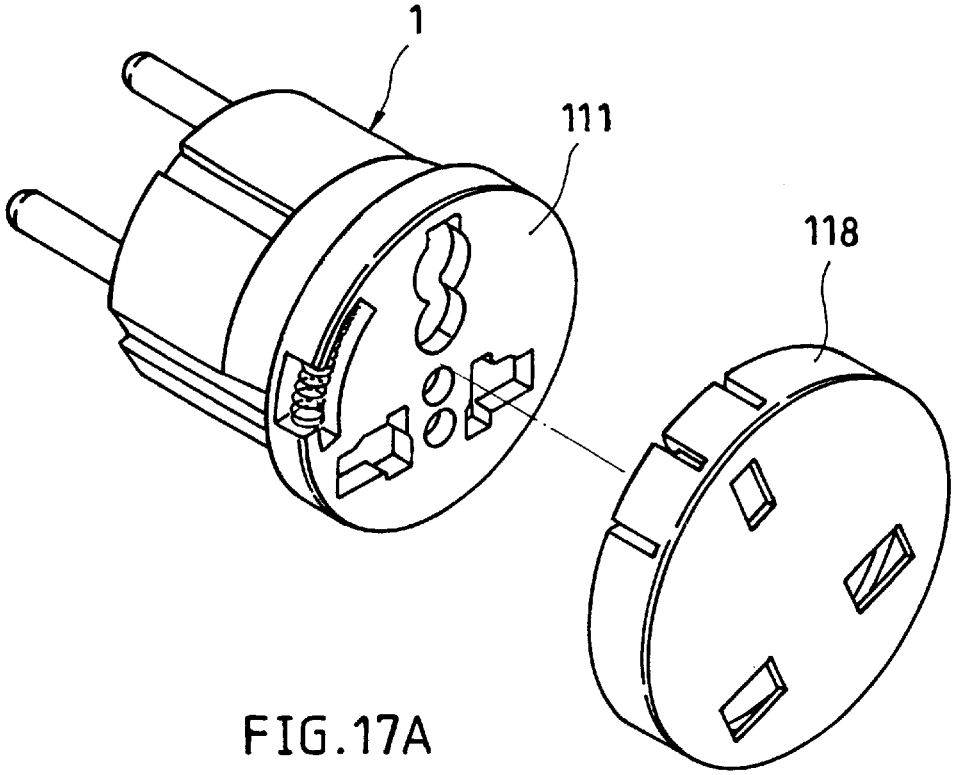
FIG. 17A is an exploded view of still another alternate form of the present invention.
Figure 17B:
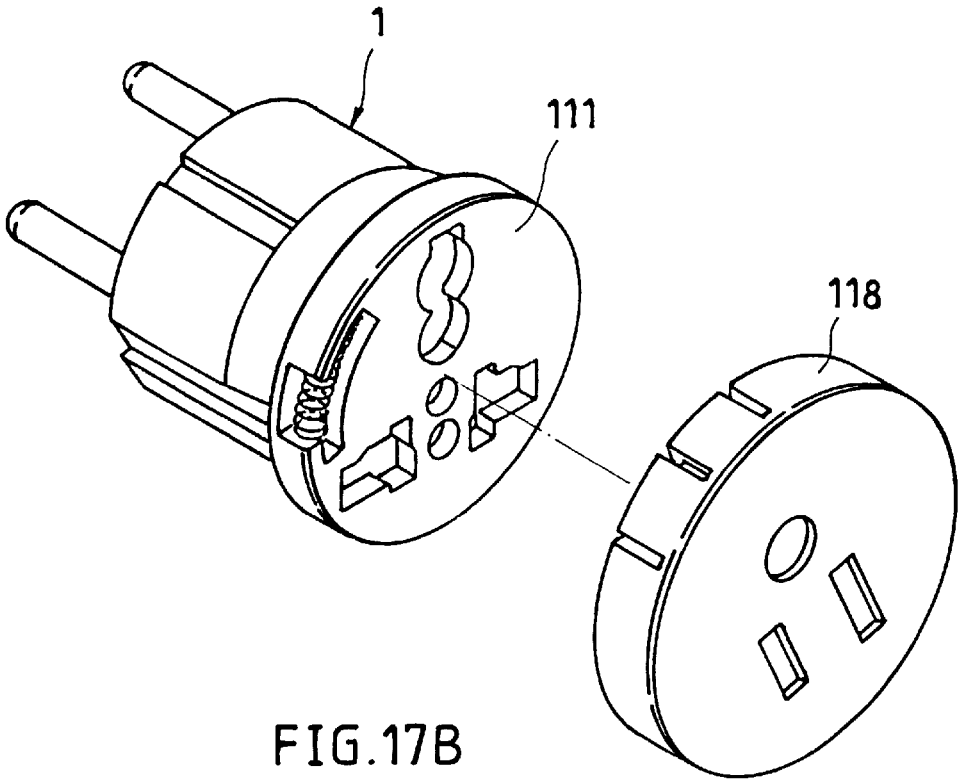
FIG. 17B is an exploded view of still another alternate form of the present invention.

Referring FIGS. 13 and 14, the grounding plates 141 and 142 each have a through hole 1412 for the mounting of a respective grounding wire 116.

Figure 12B:
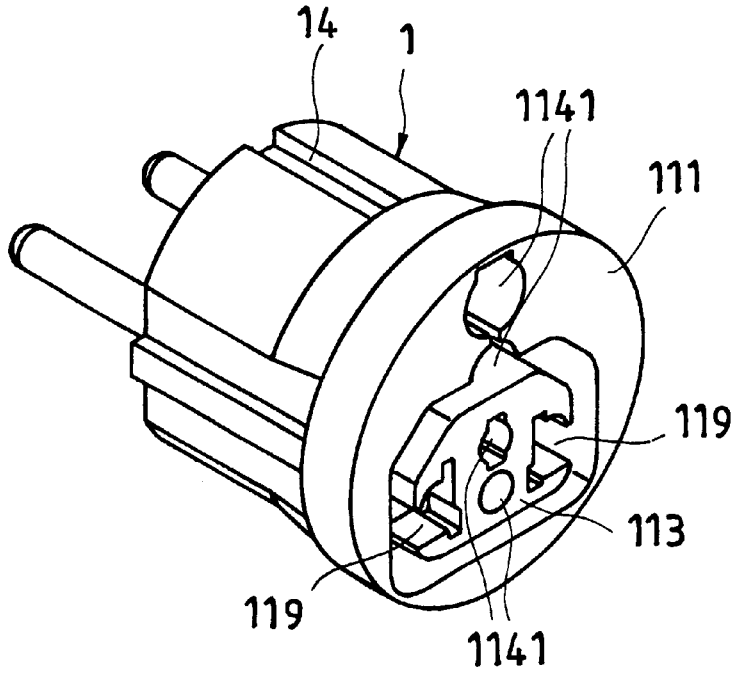
FIG. 12B is a perspective view of still another alternate form of the universal electric adapter according to the present invention.
Figure 12E:
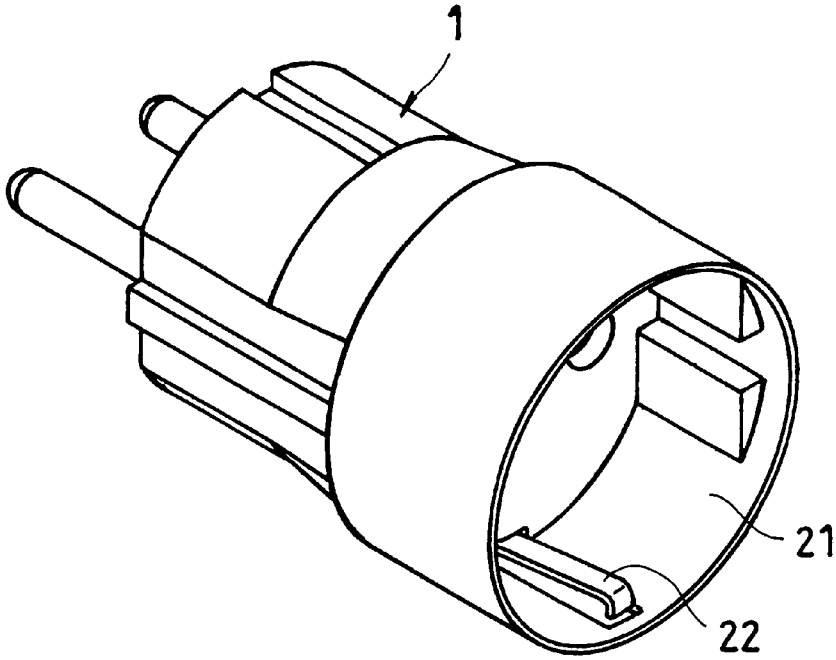
FIG. 12E illustrates still another alternate form of the universal electric adapter according to the present invention.
Figure 12C:
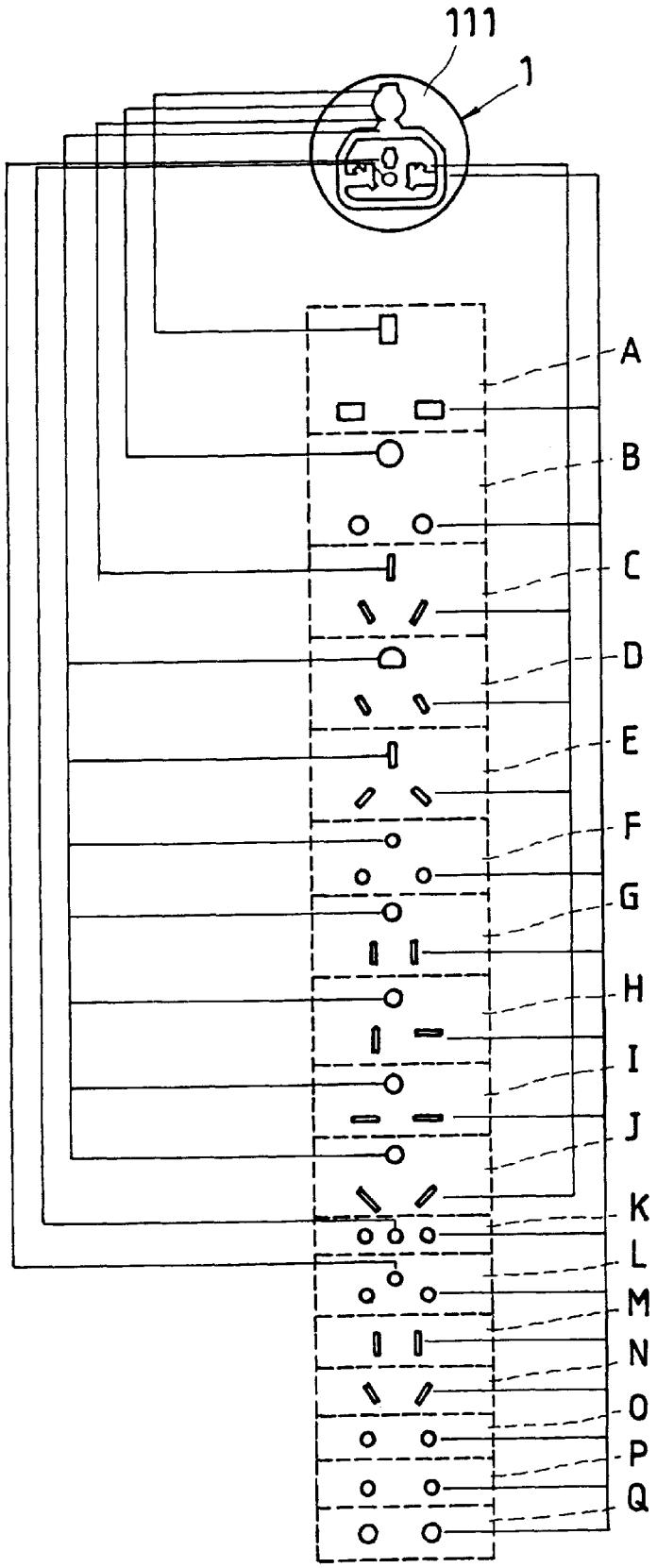
FIG. 12C is a schematic drawing showing the application of the present invention with a variety of electric plugs.

Referring to FIGS. 12B, 12C and 12D, the face panel 111 of the universal electric adapter 1 can be variously embodied to fit different electric plugs. According to the embodiment shown in FIG. 12B, the face panel 111 comprises a computer socket 113. The computer socket 113 comprises hot and neutral plug holes 113, two symmetrical openings 119 respectively bilaterally disposed in communication with the hot and neutral power plug holes 113 and a plurality of grounding terminals 1141 constructed subject to a variety of commercially available electric plugs (see FIGS. 12C and 12D).

Referring to FIG. 12E, the face panel 11 of the universal electric adapter can be made having a receiving side 21 with grounding terminals 22 adapted to receive an electric plug of German specification.

Referring to FIGS. 15, 167, 17A and 17B. the face panel 111 may be equipped with a safety cover 118. According to this embodiment, the face panel 111 comprises a recessed receiving hole 117, which receives a compression spring 1171. The safety cover 118 is covered on the face panel 111, comprising a set of insertion holes 1181 corresponding to the plug holes 112 on the face panel 111, a plurality of backwardly extended, springy, peripheral mounting strips 1182 each having an inwardly extended hooked portion 11821. and an inside projecting rod 1183. When covering the safety cover 118 on the face panel 111, the peripheral mounting strips 1182 are respectively attached to the periphery of the face panel 111, the inwardly extended hooked portion 11821 of each mounting strip 1882 is respectively hooked on the back side wall of the face panel 111 to secure the safety cover 118 to the face panel 111 and to let the safety cover 118 be rotated on the face panel 111, and the inside projecting rod 1183 is stopped at one end of the compression spring 1171. The compression spring 1171 imparts a pressure to the inside projecting rod 1183, causing the safety cover 118 to be held in the position where the insertion holes 1181 of the safety cover 118 are not in alignment with the plug holes 112 of the face panel 111, preventing an insertion of an electric plug or external body into the face panel 111. When in use. the safety cover 118 is rotated on the face panel 111 to move the insertion holes 1181 into alignment with the plugholes 112 for the installation of any of a variety of electric plugs. The insertion holes 1181 of the safety cover 118 may be made to fit different electric plugs, or one particular electric plug.

Figure 18A:
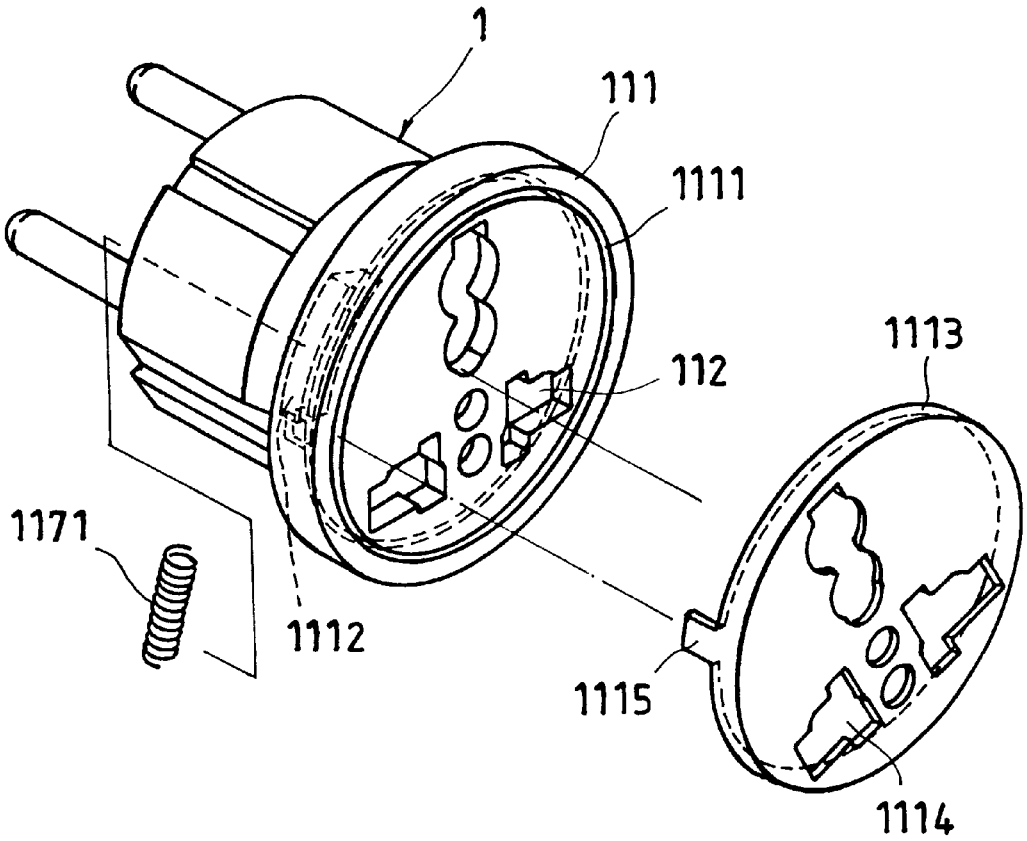
FIG. 18A is an exploded view of still another alternate form of the present invention.
Figure 18B:
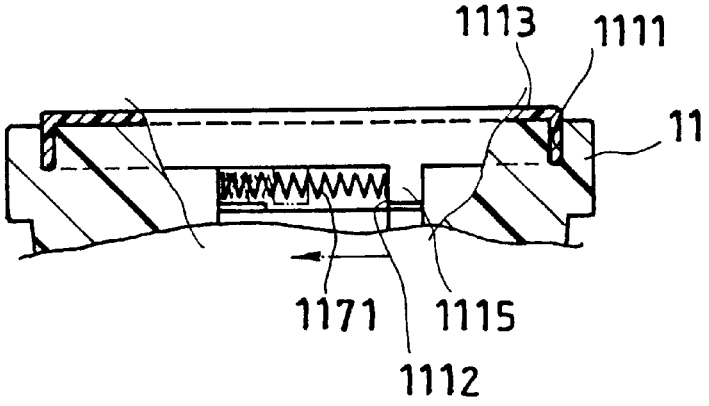
FIG. 18B is a sectional view of a part of the embodiment shown in FIG. 18A, showing the installation of the safety cover on the face panel.

Referring to FIGS. 18A and 18B, the face panel 111 may be equipped with a reversible safety cover 1113. According to this embodiment, the face panel 111 comprises an annular coupling groove 1111, a recessed receiving hole 1112 disposed in communication with the coupling groove 1111, and a compression spring 1171 mounted in the recessed receiving hole 1112. The reversible safety cover 1113 is coupled to and rotated in the annular coupling groove 1111 of the face panel 111, having a set of insertion holes 1114 for the insertion of any of a variety of electric plugs, and a back projecting rod 1115 inserted into the recessed receiving hole 1112 and stopped at one end of the compression spring 1171. The compression spring 1171 imparts a pressure to the back projecting rod 1115, causing the safety cover 1113 to be held in the position where the insertion holes 1114 of the safety cover 1113 are not in alignment with the plug holes 112 of the face panel 111, preventing an insertion of an electric plug or external body into the face panel 111. When in use, the safety cover 1113 is rotated in the annular coupling groove 1111 to move the insertion holes 1114 into alignment with the plugholes 112. After each use, the compression spring 1171 pushes the safety cover 1113 back to its former position.

Figure 19:
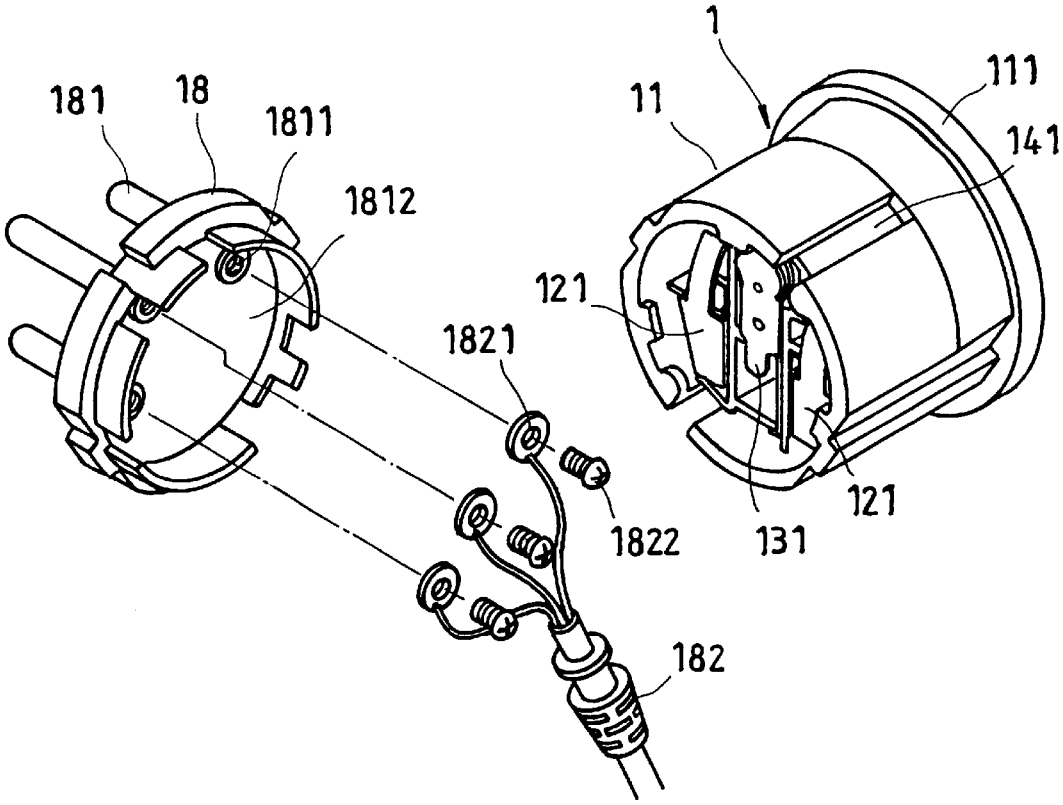
FIG. 19 is an exploded view of still another alternate form of the present invention.
Figure 20:
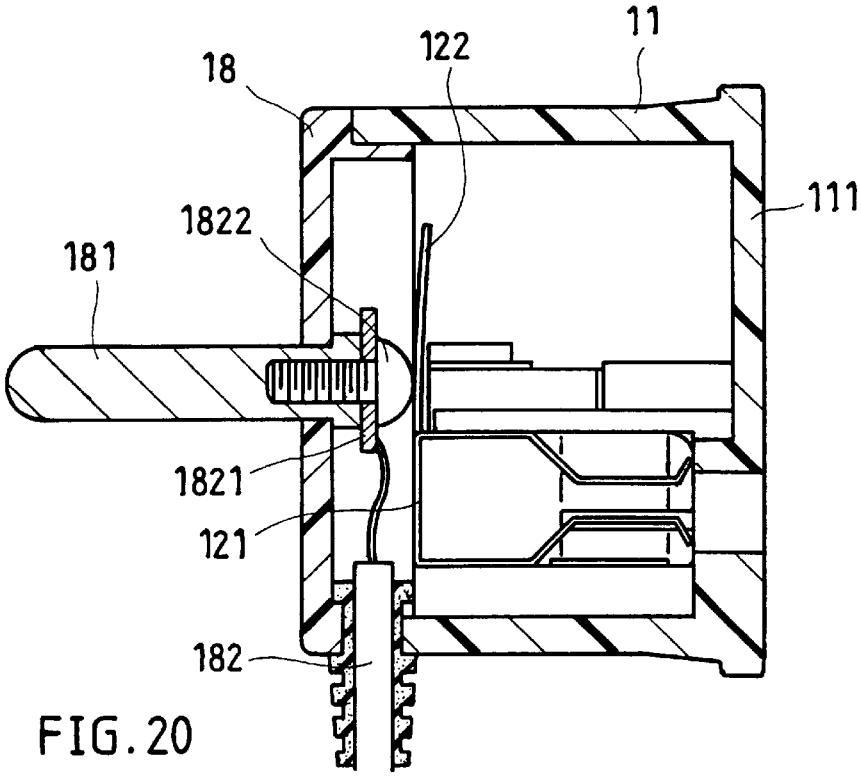
FIG. 20 is a sectional assembly view in an enlarged scale of FIG. 19.
Figure 22:
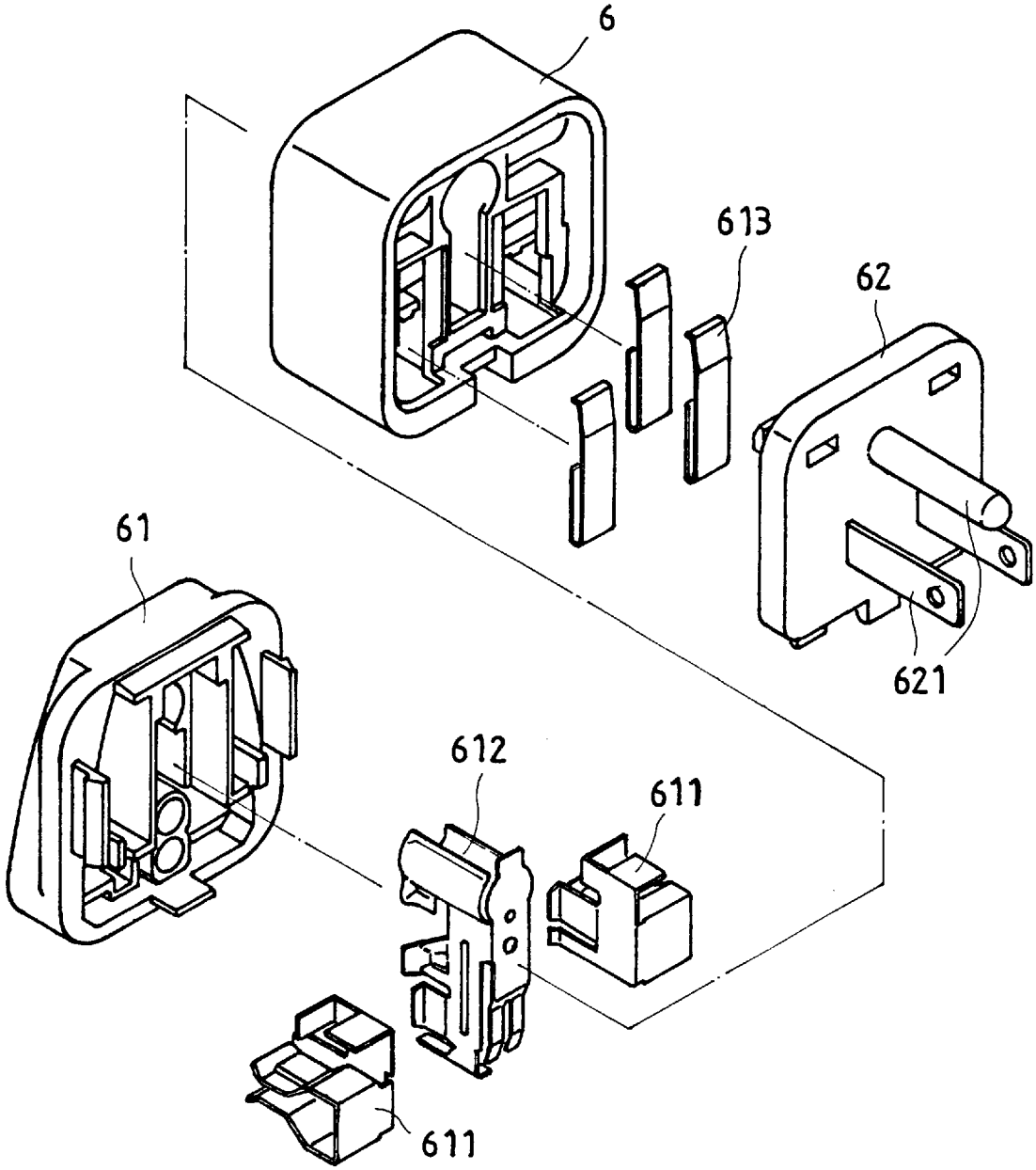
FIG. 22 PRIOR ART
FIG. 22 is an exploded view of an electric adapter according to the prior art.
Figure 23:
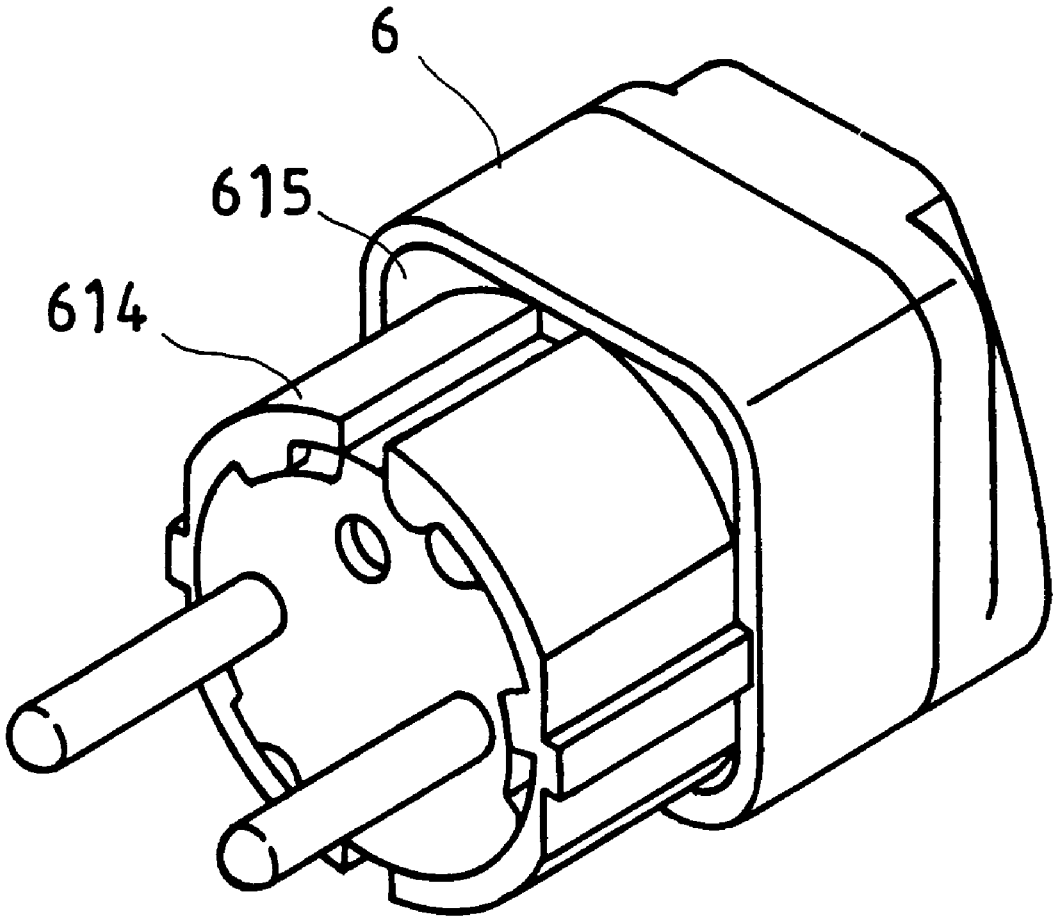
FIG. 23 PRIOR ART
FIG. 23 is an exploded view of another structure of electric adapter according to the prior art.

Referring to FIGS. 19 and 20, the plug member, referenced by 18, comprises an electric wire distribution chamber 1182 in the back side thereof, and each prong 181 of the plug member 18 has an inner end terminating in a screw hole 1181. The annular terminals 1821 of the wires of a three-line electric cable, referenced by 182, are respectively fastened to the screw hole 1811 of each prong 181 of the plug member 18 by a respective metal screw 1822. After installation of the plug member 18, the annular terminals 1821 with the respective metal screws 1822 are maintained in contact with the metal contact frames 121 and the grounding frame 131 in the casing 11 of the universal electric adapter 1.

Figure 21:
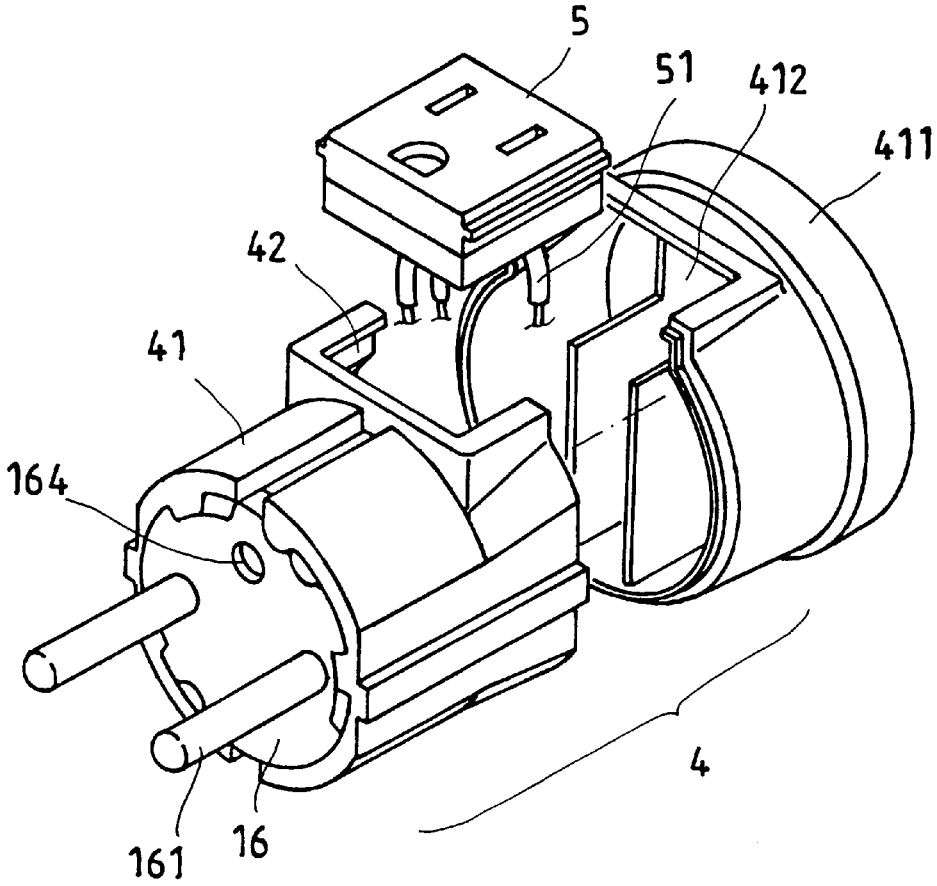
FIG. 21 is an exploded view of still another alternate form of the present invention.

Referring to FIG. 21, the universal electric adapter, referenced by 4, comprises a casing 41, a face panel 411, a plug member 16, and an electric socket 5. The plug member 16 may be variously embodied as stated above. The casing 41 has a coupling hole 42 at one side remote from the plug member 16. The face panel 411 has a coupling hole 412 at the backside thereof. The electric socket 5 is fastened to the coupling hole 42 of the casing 41 and the coupling hole 412 of the face panel 411, having electric wires 51 respectively fastened to the metal contact frames and grounding frame in the casing 41.

It is to be understood that the drawings are designed for purposes of illustration only, and are not intended for use as a definition of the limits and scope of the invention disclosed. For example, the plug member 16 can be fixedly fastened to the casing 111 by a high-frequency sealing apparatus.

What the invention claimed is:

1. A universal electric adapter comprising:

a casing injection-molded from plastics, said casing comprising a face panel disposed at a front side thereof, two lateral receiving chambers bilaterally disposed on the inside and backwardly extended to a rear open side thereof, a middle receiving chamber disposed on the inside in the middle between said lateral receiving chambers and backwardly extended to the rear open side, a first locating groove inside said middle receiving chamber, a plurality of coupling flanges radially inwardly disposed around the rear open side, a positioning projection radially inwardly suspended in the rear open side, and two second locating grooves disposed at the periphery thereof at two opposite sides;

two metal contact frames respectively installed in the lateral receiving chambers of said casing, said metal contact frames each comprising a protruded contact strip;

a grounding frame installed in the middle receiving chamber of said casing, said grounding frame comprising a contact base, and a locating flange fastened to the locating groove inside the middle receiving chamber of said casing;

a plug member fastened to the rear open side of said casing, said plug member comprising a plurality of backwardly extended metal prongs adapted for fastening to an electric socket, a plurality of coupling grooves spaced around the periphery thereof and respectively engaged with the coupling flanges of said casing, and a plurality of peripheral notches respectively disposed in communication with the coupling grooves of said plug member and adapted to receive the coupling flanges of said casing for enabling the coupling flanges of said casing to be respectively forced into engagement with the coupling grooves of said plug member upon a relative rotation motion between said plug member and said casing;

a first grounding plate and a second grounding plate respectively fastened to the second locating grooves of said casing and disposed in contact with said grounding frame.

2. The universal electric adapter of claim 1 wherein said casing further comprises a back positioning projection, and said plug member further comprises a peripheral positioning recess adapted to receive the positioning projection of said casing.

3. The universal electric adapter of claim 1 wherein said plug member is positioned on said casing at a deflection angle where the metal prongs of said plug member are not in alignment with respective plug holes on said face panel of said casing and the metal prongs of said plug member are maintained in contact with the contact strip of each of said metal contact frames, comprising a plug hole adapted for receiving the grounding prong of an electric socket of French specification, enabling the grounding prong of the electric socket of French specification to contact a contact flange of said first grounding plate.

4. The universal electric adapter of claim 1 wherein said plug member is fastened to said casing by a high-frequency scaling apparatus.

5. The universal electric adapter of claim 1 wherein said plug member is a universal plug member adapted to fit different electric sockets.

6. The universal electric adapter of claim 1 wherein said face panel comprises a set of plugholes adapted to receive different electric plugs.

7. The universal electric adapter of claim 1 wherein said face panel comprises an electric socket adapted to receive an electric plug of German specification.

8. The universal electric adapter of claim 1 wherein said face panel comprises a computer socket adapted to receive a computer plug.

9. The universal electric adapter of claim 8 wherein said computer socket comprises hot and neutral power plug holes, a grounding plug hole, and two symmetrical openings respectively bilaterally disposed in communication with said hot and neutral power plug holes to fit different electric plugs.

10. The universal electric adapter of claim 1 wherein said first grounding plate and said second grounding plates each have a through hole for the mounting of a respective grounding wire.

11. The universal electric adapter of claim 1 wherein said face panel is covered with a safety cover, comprising a set of plug holes adapted to receive one of a set of commercially available electric plugs, a recessed receiving hole and a compression spring mounted in said recessed receiving hole, said safety cover being covered on said face panel and comprising a set of insertion holes corresponding to said plug holes of said face panel, a plurality of backwardly extended, springy, peripheral mounting strips respectively coupled to said face panel for enabling said safety cover to be rotated on said face panel, and an inside projecting rod stopped at one end of said compression spring.

12. The universal electric adapter of claim 1 wherein said face panel is covered with a reversible safety cover, comprising an annular coupling groove, a set of plug holes, a recessed receiving hole disposed in communication with said annular coupling groove, and a compression spring mounted in said recessed receiving hole, said reversible safety cover being coupled to and rotated in said annular coupling groove of said face panel, and having a set of insertion holes corresponding to the plug holes of said face panel for the insertion of an electric plug, and a back projecting rod inserted into said the recessed receiving hole and stopped at one end of said compression spring.

13. The universal electric adapter of claim 12 wherein the set of insertion holes of said safety cover and the plug holes of said face panel fit a set of electric plugs of different specifications.

14. The universal electric adapter of claim 1 wherein said plug member comprises an electric wire distribution chamber in a back side thereof, a plurality of metal prongs adapted for connection to an electric socket, said metal prongs each having an inner end terminating in a screw hole, and a three-line electric cable fastened to said metal prongs, said three-line electric cable having three electric wires respectively terminating in a respective annular terminal respectively fastened to the screw hole of each of said metal prongs by a respective metal screw and disposed in contact with said metal contact frames and said grounding frame of said casing.

15. The universal electric adapter of claim 1 wherein said casing and said face panel each have a coupling hole adapted to receive an electric socket.

* * * * *